US007455544B2

(12) United States Patent
Glauning et al.

(10) Patent No.: US 7,455,544 B2
(45) Date of Patent: Nov. 25, 2008

(54) DEVICE FOR LOCKING A BATTERY PACK IN A GUIDE OF A POWER TOOL

(75) Inventors: Rainer Glauning, Aichtal-Groetzingen (DE); Wolf Matthias, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 516 days.

(21) Appl. No.: 10/562,668

(22) PCT Filed: Aug. 4, 2005

(86) PCT No.: PCT/EP2005/053830

§ 371 (c)(1),
(2), (4) Date: Dec. 28, 2005

(87) PCT Pub. No.: WO2006/040204

PCT Pub. Date: Apr. 20, 2006

(65) Prior Publication Data

US 2008/0150481 A1 Jun. 26, 2008

(30) Foreign Application Priority Data

Oct. 8, 2004 (DE) ..... 10 2004 049 085

(51) Int. Cl.
*H01R 13/627* (2006.01)

(52) U.S. Cl. ..... 439/352; 310/50; 173/217

(58) Field of Classification Search ..... 439/345, 439/352, 500, 504, 577; 310/50; 173/217
See application file for complete search history.

(56) References Cited

U.S. PATENT DOCUMENTS

| | | | | |
|---|---|---|---|---|
| 6,357,534 | B1 | 3/2002 | Buetow | |
| 6,376,942 | B1 | 4/2002 | Burger | |
| 6,955,549 | B2 * | 10/2005 | Brazell et al. | 439/160 |
| 2004/0192106 | A1 * | 9/2004 | Britz | 439/577 |

FOREIGN PATENT DOCUMENTS

| | | |
|---|---|---|
| DE | 101 24 537 A1 | 2/2002 |
| GB | 2 302 202 | 2/1997 |

* cited by examiner

*Primary Examiner*—Tho D Ta
(74) *Attorney, Agent, or Firm*—Michael J. Striker

(57) ABSTRACT

The present invention relates to a device for locking a battery pack (6) in a guide (10) of a power tool (4); when the battery pack (6) is being slid into the guide (10), it is first able move into a front locked position in which it is locked in relation to the power tool (6), but there is no electrical contact between the power tool (4) and battery pack (6), and is then able to move further into a rear locked position in which it is locked in relation to the power tool (4) and an electrical contact is produced between the battery pack (6) and the power tool (4); it is possible to manually release the battery pack (6) for removal and to move it from the rear locked position, through the front locked position, and out of the guide (10). According to the present invention, the power tool (4) has a locking mechanism (20), which remains in locked engagement with the battery pack (6) as the battery pack (6) is being moved between the two locked positions and, together with the battery pack (6), is able to move in relation to the power tool (4).

10 Claims, 2 Drawing Sheets

DEVICE FOR LOCKING A BATTERY PACK IN A GUIDE OF A POWER TOOL

The present invention relates to a device for locking a battery pack in a guide of a power tool according to the preamble to claim 1 and a power tool according to the preamble to claim 10.

PRIOR ART

Hand-guided cordless power tools that are supplied with power by a battery pack are usually provided with a locking device for attaching the battery pack to the power tool during operation. In order to prevent the battery pack from accidentally detaching from the power tool when it is not properly locked to it, some of the applicant's larger and heavier power tools are already provided with a device of the type mentioned at the beginning, which permits a two-stage locking that is also referred to as double locking. With this device, when the battery pack is slid into the guide, spring force brings a spring-loaded locking mechanism of the power tool successively into engagement with two detent recesses situated one after the other in the insertion direction in the battery pack. When the locking mechanism engages in the first detent recess, i.e. in the front locked position, the battery pack is only secured in relation to the power tool, whereas an electrical connection is produced only when the locking mechanism engages in the second detent recess, i.e. in the rear locked position. In order to remove the battery pack, the power tool is provided with a release mechanism that is usually embodied in the form of a pushbutton and is actuated in order to unlock the battery pack before removal. The known device is in fact able to prevent the battery pack from accidentally detaching from the power tool when the locking mechanism is either not engaged or not properly engaged in the rear detent recess, for example because the user has not slid the battery pack in the guide all the way into the rear locked position. But if the user actuates and holds down the release mechanism in order to remove the battery pack or if the release mechanism jams during releasing or the locking mechanism jams in its releasing position, the battery pack can accidentally slide out from the guide to fall to the ground if at the time, the guide is pointing obliquely downward opposite the insertion direction and the battery pack is not being held. Particularly when working at elevated heights, this presents a danger of severe injury to other people.

ADVANTAGES OF THE INVENTION

When the battery pack is being removed, since the locking mechanism moves into the front locked position along with the battery pack and consequently maintains the locking engagement of the battery pack between the two locked positions, the device according to the present invention, with the defining characteristics mentioned in claim 1, has the advantage of preventing the battery pack from accidentally moving beyond the front locked position in the removal direction, thus preventing it from sliding out of the guide until the release mechanism is actuated again in the front locked position.

Between the rear locked position and the front locked position, the release mechanism preferably remains in an actuated position in which it cannot move further and only returns to a non-actuated position when the battery pack reaches the front locked position. A renewed actuation of the release mechanism then permits the locking mechanism to disengage from the battery pack in order to fully release the lock between the battery pack and the power tool for removal of the battery pack.

Preferably, the locking mechanism and the release mechanism are embodied of one piece and suitably constitute the two arms of a two-armed lever whose one lever arm, in the non-actuated position, protrudes above a housing of the power tool and serves as a release mechanism, while its other lever arm serves as a locking mechanism and engages with a recess in the battery pack.

In order to maintain the locking engagement between the rear locked position and the front locked position, according to an advantageous embodiment of the present invention, the locking mechanism can be actuated in the rear locked position in order to disengage it from the power tool so that it can move along with the battery pack into the front locked position in which it can be actuated once again in order to disengage it from the battery pack.

In order on the one hand to permit the release mechanism to be actuated in both the rear locked position and the front locked position and on the other hand, to permit the locking mechanism to move along with the battery pack between these locked positions, according to another advantageous embodiment of the invention, the locking mechanism is provided with a first degree of movement freedom in the front and rear locked positions that permits it to disengage from the battery pack and/or from the power tool and between these two positions, it can move with a second degree of movement freedom that permits it to move together with the battery pack in relation to the power tool and thus to remain in the actuated position.

To that end, the locking mechanism can be suitably slid along a guide channel of the power tool, which channel permits different movements depending on the current locked position. Preferably, the locking mechanism can be rotated in the front and rear locked positions and can be moved linearly in the direction of the guide between these positions. The guide channel is preferably embodied so that in the front and rear locked positions, the two-armed lever engages by means of protruding axle pins in a section of the guide channel that is oriented essentially transversely in relation to the insertion direction of the guide so that in these sections, when the release mechanism is actuated, the locking mechanism can rotate around different rotation axes in order to disengage it from the battery pack and/or the power tool.

According to another preferred embodiment of the present invention, the power tool has a spring that acts on the locking mechanism and moves it, preferably together with the battery pack, into the front locked position as soon as the release mechanism has been actuated in the rear locked position. This automatically and reliably disconnects the electrical contacts of the battery pack and the power tool from each other immediately after actuation of the release mechanism and makes this non-operational state clearly visible to the user. The spring also causes the battery pack to move back into the front locked position if it has not been properly locked into the rear locked position when being slid in the guide, making this fact also visible to the user.

DRAWINGS

An exemplary embodiment of the present invention will be explained in greater detail below in conjunction with the accompanying drawings.

DESCRIPTION OF THE EXEMPLARY EMBODIMENT

Figure 1:
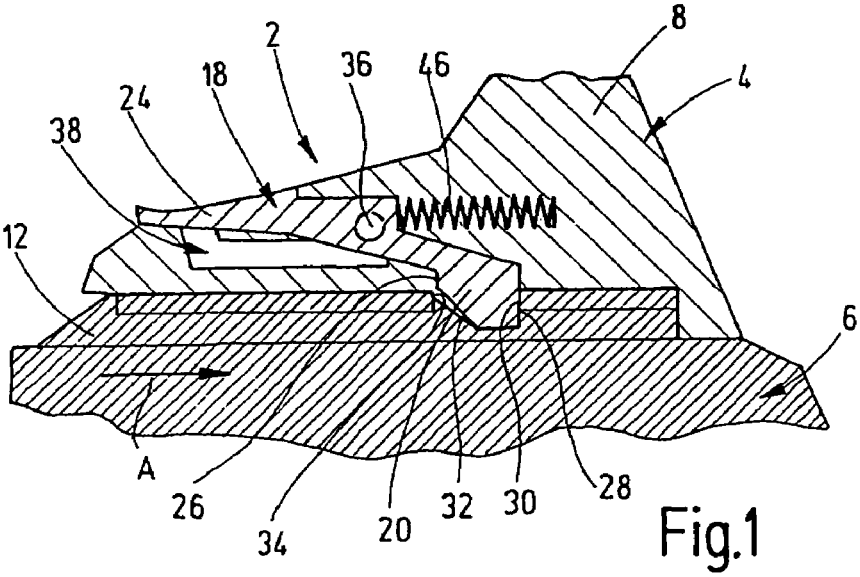
FIG. 1 shows a partial cross section through a power tool and a battery pack in the locked and operational state.

The locking mechanism 2 shown in the drawings is used to produce a reciprocal locking engagement between a cordless power tool 4, for example a hand-guided rotary hammer, and a battery pack 6 required to supply power to the power tool 4.

As shown in FIGS. 1 through 6, at the free lower end of its handle part 8, the power tool 4 has a guide groove 10 let into it, into which a guide rail 12, which has a cross section complementary to the cross section of the guide groove 10 and is situated at the upper end of the battery pack 6, can be slid in order to attach the battery pack 6 to the power tool 4.

The insertion movement of the guide rail 12 into the guide groove 10 is limited by cooperating stop faces 14, 16 at the rear ends of the guide rail 12 and guide groove 10 in the insertion direction, which rest against each other when the battery pack 6 is properly locked onto the power tool 4 in a rear locked position shown in FIG. 1 and an electrical connection is produced between the connection contacts of the power storage unit of the battery pack 6 and a power circuit of a consumer of the power tool 4.

In order to hold the battery pack 6 in the rear locked position shown in FIG. 1, the locking device 2 integrated into the power tool 4 has a two-armed lever 18, whose one lever arm constitutes a locking mechanism 20 and in the rear locked position, engages in a recess 22 in the top side of the guide rail 12, whereas its other lever arm constitutes a release button 24 that protrudes from an outer surface of the handle part 8 of the power tool 4 and can be manually depressed in the rear locked position in order to unlock the battery pack 6.

The locking mechanism 20 is provided with a rear stop face 28 oriented essentially perpendicular to the insertion direction (arrow A in FIG. 1), which, in the rear locked position, rests against a complementary stop face 30 in the recess 22 and prevents the battery pack 6 from moving counter to the insertion direction. The locking mechanism 20 is also provided with a front insertion bevel 32 that faces a corresponding insertion bevel 34 in the recess 22. The upper end of the insertion bevel 32 adjoins an additional stop face 26 oriented perpendicular to the insertion direction while a corresponding stop face 27 is situated above the insertion bevel 34 in the recess 22. The recess 22 is slightly larger than the locking mechanism 20 so that the locking mechanism can pivot slightly inside the recess 22.

The lever 18 has two axle pins 36 protruding from its opposing longitudinal side surfaces, which are supported so they can move in a recessed guide channel in the handle part 8. The guide channel is comprised of two opposing recesses 38 in the handle part, each of which has a long middle part 40 parallel to the movement direction of the guide rail 12 in the guide groove 10 and two segments 42 and 44 that protrude upward from the middle part 40 at the front and rear ends and are oriented at an angle of approx. 80° to approx. 100° in relation to the insertion direction.

The locking mechanism 2 also has a helical compression spring 46 that acts on the lever 18; the front end of this spring rests against a shoulder 48 of the lever 18 and its rear end rests against the handle part 8.

The operation of the locking mechanism 2 will be described below with reference to FIGS. 1 through 6.

In the rear locked position shown in FIG. 1, the locking mechanism 20 engages in the recess 22 in the guide rail 12 of the battery pack 6 while the two axle pins 36 of the lever 18 are situated in the rear segments 44 of the guide channel 38 that are oriented approximately transversely in relation to the insertion direction; in this position, the force of the compressed spring 46 presses the axle pins 36 against a front boundary wall of these segments 44. The frictional contact with this wall holds the axle pins 36 in the segments 44 and thus locks and immobilizes the battery pack 6 in the rear locked position in relation to the power tool 4. As explained above, in this position, connecting contacts of the power storage unit of the battery pack 6 and the power circuit of the consumer of the power tool 4 are electrically connected to each other (not shown).

Figure 2:
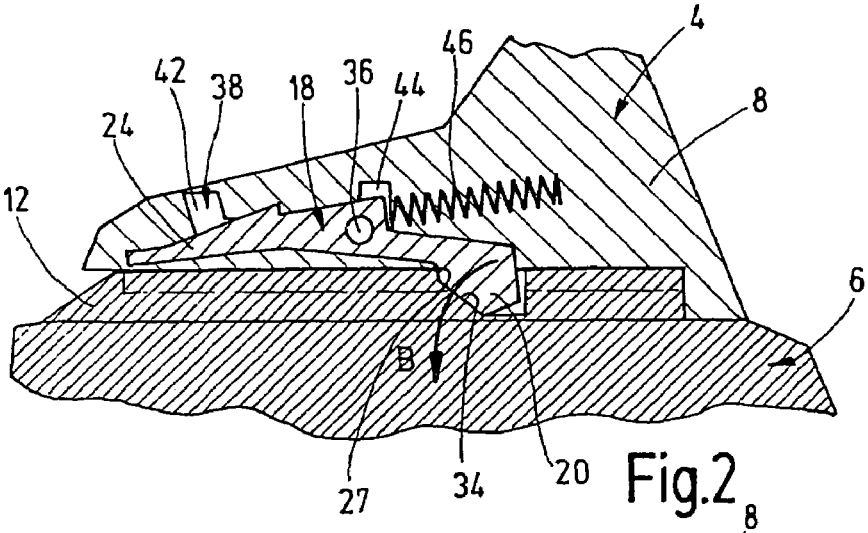
FIG. 2 shows a view that corresponds to FIG. 1, but after actuation of a release mechanism for removal of the battery pack.

If the release button 24 is manually depressed in this position for removal of the battery pack 6, the lever 18 rotates around a rotation axis situated within the locking mechanism 20, as indicated by the arrow B in FIG. 2. As a result, the two axle pins 36 of the lever 18 move downward toward the battery pack 6 until they reach the rear end of the middle part 40 of the guide channel 38 and the force of the helical compression spring 46 slides the entire lever 18 counter to the insertion direction, forward along the middle part 40, as indicated by the arrow C in FIG. 3. After the lever 18 is pivoted, the two stop faces 26, 27 of the locking mechanism 20 and recess 22 face each other so that the battery pack 6, while maintaining its locking engagement with the lever 18, is moved forward along with the battery pack 6, as indicated by the arrow D in FIG. 3. During this movement, the release button 24 remains in its depressed position in which it cannot be actuated.

Figure 4:
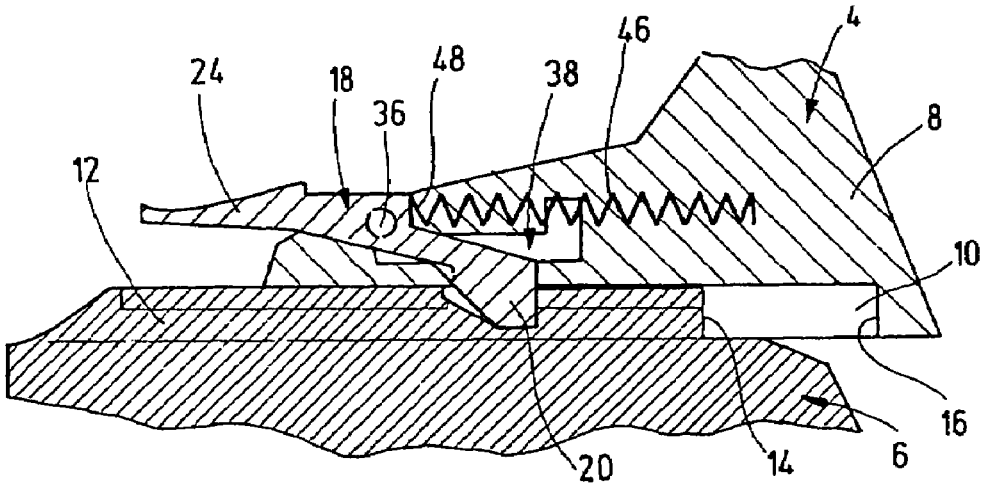
FIG. 4 shows a view that corresponds to FIG. 3 that shows the battery pack in a locked, but non-operational state.

When the axle pins 36 reach the front ends of the middle parts 40 of the guide channel 38, the helical compression spring 46 pushes them up into the segments 42 along their inclined front boundary walls, as shown in FIG. 4. In this position, the lever 18 and the battery pack 6 assume a definite front locked position in which the battery pack 6 is locked in relation to the power tool 4, but there is no electrical connection between the power storage unit of the battery pack 6 and the power circuit of the consumer of the power tool 4 since their electrical contacts are spaced apart from one another. In the front locked position, the release button 24 protrudes from the handle part 8 again so that it can be depressed in order to completely release the battery pack 6.

Figure 5:
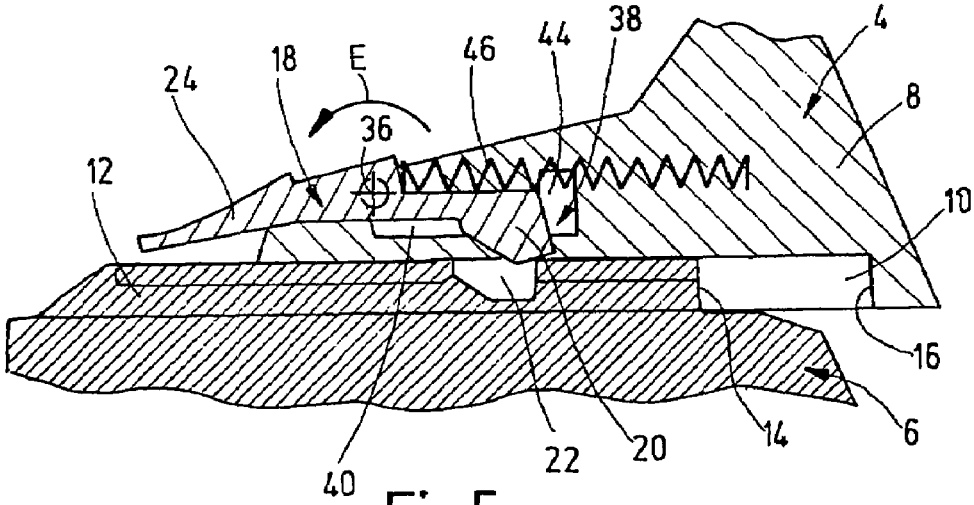
FIG. 5 shows a view that corresponds to FIG. 4, but after another actuation of the release mechanism.
Figure 6:
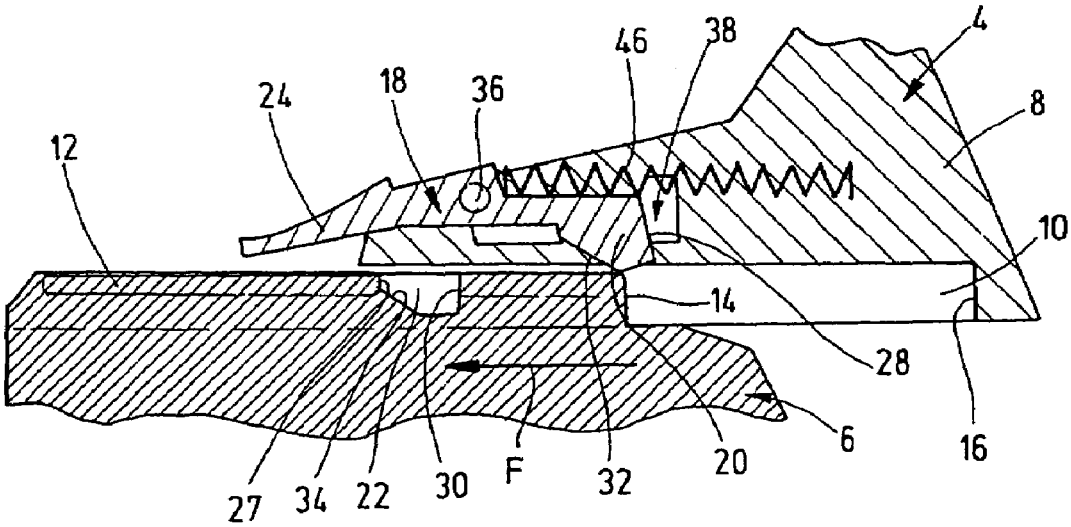
FIG. 6 shows a view that corresponds to FIG. 5, but after a complete removal of the battery pack.

When this release button 24 is depressed, the lever 18 pivots around the axle pins 36 situated in the segments 42, as indicated by the arrow E in FIG. 5, which disengages the locking mechanism 20 from the recess 22. This releases the battery pack 6 so that it can be moved all the way out of the guide 10 of the power tool 4, counter to the insertion direction, as indicated by the arrow F in FIG. 6.

When a new battery pack 6 is inserted into the guide groove 10 of the power tool 4, the movement sequence is essentially reversed. If the locking mechanism 20 has not yet reached the position shown in FIG. 6 during insertion of the battery pack 6, then it is pivoted into this position when the upper edge of the stop face 14 of the battery pack 6 comes into contact with the locking mechanism 20 and slides along its insertion bevel 32. As the insertion of the battery pack 6 continues, when the recess 22 moves into position under the locking mechanism

Figure 3:
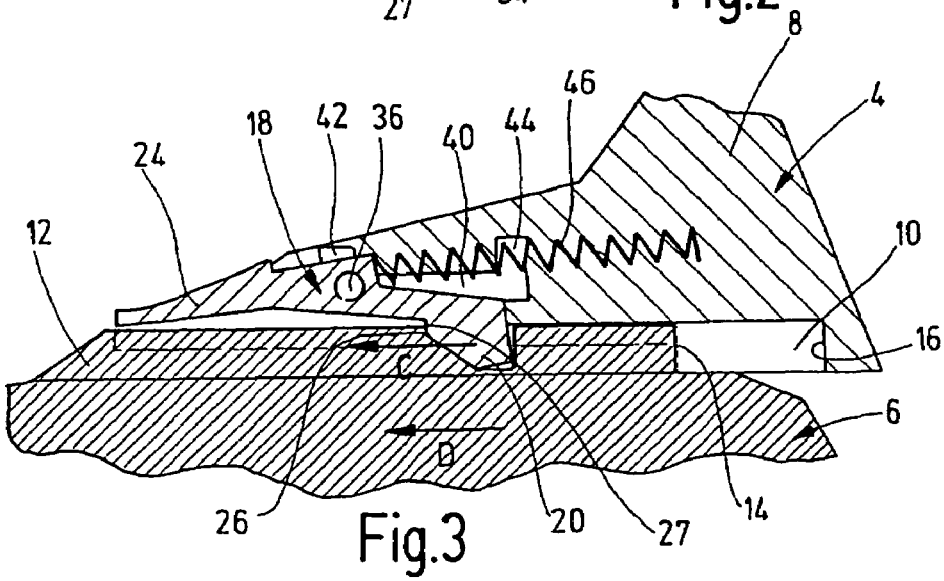
FIG. 3 shows a view that corresponds to FIG. 2, but during a movement into a locked, but non-operational state.

20, the latter rotates around the axle pins 36 situated in the segments 42 of the guide channel 38, whereupon the battery pack 6 is locked in the front locked position shown in FIG. 4 without achieving an electrical connection with the power tool 4. The locking mechanism 20 is then pivoted slightly until its stop face 26 comes into contact with the stop face 27 in the recess 22 and the axle pins 36 move out of the segments 42 into the middle parts 40 of the guide channel 38, as shown in FIG. 3. Then, the battery pack 6 can be slid counter to the force of the spring 46 into the rear locked position in which the axle pins move into the segments 44 of the guide channel 38 and an electrical connection is produced between the power storage unit of the battery pack 6 and the power circuit of the consumer of the power tool 4.

What is claimed is:

1. A device for locking a battery pack in a guide of a power tool in which, when the battery pack is being slid into the guide, it is first able to move into a front locked position in which it is locked in relation to the power tool, but there is no electrical contact between the power tool and the battery pack, and is then able to move further into a rear locked position in which it is locked in relation to the power tool and an electrical contact is produced between the battery pack and the power tool; it is also possible to manually release the battery pack for removal and to move it from the rear locked position, through the front locked position, and out of the guide, wherein the power tool (4) has a locking mechanism (20), which remains engaged with the battery pack (6) as the battery pack (6) is being moved between the two locked positions and, together with the battery pack (6), is able to move in relation to the power tool (4).

2. The device as recited in claim 1, wherein it is possible to disengage the locking mechanism (20) from the power tool (4) in the rear locked position.

3. The device as recited in claim 1, wherein it is possible to disengage the locking mechanism (20) from the battery pack (6) in the front locked position.

4. The device as recited in claim 1, characterized by means of a spring (46), which, after a manual actuation in the rear locked position, moves the locking mechanism (20) into the front locked position.

5. The device as recited in claim 4, wherein the locking mechanism (20) moves into the front locked position along with the battery pack (6).

6. The device as recited in claim 1, wherein as it is inserted into the guide (10), the battery pack (6), together with the locking mechanism (20), is able to move out of the front locked position into the rear locked position counter to the force of the spring (46).

7. The device as recited in claim 1, wherein the locking mechanism (20) is able, with a first degree of movement freedom, to disengage from a locking engagement with the power tool (4) and/or the battery pack (6) and, with a second degree of movement freedom, is able to move together with the battery pack (6) in relation to the power tool (4).

8. The device as recited in claim 1, wherein the locking mechanism (20) is able to slide along a guide channel (38) of the power tool (4); in the rear locked position, the locking mechanism (20) engages in a section (44) of the guide channel (38), which is oriented essentially transversely in relation to the insertion direction and from this position, it is possible to move the locking mechanism (20) by manually actuating it in order to disengage it from a locking engagement with the power tool (4).

9. The device as recited in claim 1, wherein the locking mechanism (20) is able to slide along a guide channel (38) of the power tool (4); in the front locked position, it engages in a section (42) of the guide channel (38) that is oriented essentially transversely in relation to the insertion direction and in this position, the locking mechanism (20) is able to pivot when manually actuated in order to disengage it from a locking engagement with the battery pack (69).

10. A power tool having a guide in which it is possible to lock a battery pack used as a power supply for the power tool; when the battery pack is being slid into the guide, it is first able to move into a front locked position in which it is locked in relation to the power tool, but there is no electrical contact between the power tool and the battery pack, and is then able to move further into a rear locked position in which it is locked in relation to the power tool and an electrical contact is produced between the battery pack and the power tool; and when the battery pack is being removed from the guide after a manual actuation of a locking mechanism of the power tool, it is possible to move the battery pack along the guide from the rear locked position into the front locked position, wherein the locking mechanism (20) remains in locked engagement with the battery pack (6) as the battery pack (6) is being moved between the two locked positions and, together with the battery pack (6), is able to move in relation to the power tool (4).

* * * * *